US006810798B2

(12) United States Patent
Murakami et al.

(10) Patent No.: US 6,810,798 B2
(45) Date of Patent: Nov. 2, 2004

(54) SCREEN PRINTING PROCESS INCLUDING VERTICALLY MOVING SQUEEGEE TO OPEN AND CLOSE PASTE SUPPLY PORT

(75) Inventors: Takehiko Murakami, Inagi (JP); Shunji Murano, Fuchu (JP); Takamasa Miyata, Tokyo (JP)

(73) Assignee: Minami Co., Ltd., Tokyo (JP)

( * ) Notice: Subject to any disclaimer, the term of this patent is extended or adjusted under 35 U.S.C. 154(b) by 0 days.

(21) Appl. No.: 10/625,165

(22) Filed: Jul. 23, 2003

(65) Prior Publication Data

US 2004/0069165 A1 Apr. 15, 2004

Related U.S. Application Data

(62) Division of application No. 10/067,437, filed on Feb. 5, 2002, now Pat. No. 6,619,197.

(30) Foreign Application Priority Data

Sep. 2, 2001 (JP) ..... 2001-034404

(51) Int. Cl.[7] ..... B41F 15/44; B41L 13/18
(52) U.S. Cl. ..... 101/129; 101/123; 118/406
(58) Field of Search ..... 101/114, 123, 101/124, 129, 119, 120; 427/96; 118/406, 213

(56) References Cited

U.S. PATENT DOCUMENTS 5,715,748 A * 2/1998 Murakami et al. ..... 101/114
2002/0053292 A1 * 5/2002 Abe et al. ..... 101/123
2003/0033943 A1 * 2/2003 Murakami ..... 101/116

* cited by examiner

*Primary Examiner*—Leslie J. Evanisko
(74) *Attorney, Agent, or Firm*—ZITO tlp; Joseph J. Zito; Kendal M. Sheets

(57) ABSTRACT

To keep a printing paste, which is most influential to a printing performance, always in a uniform state, carry out printing at a high accuracy and in a stable manner, and use an expensive paste with no waste, there is provided a printing paste automatic supplying apparatus which supplies a predetermined amount of printing paste (5) by charging the printing paste (5) in a printing paste supply bag (15) and pressurizing the printing paste (5), provided with a mechanism for opening and closing a printing paste supply port (7) by bringing a printing paste supply plate (6) having the printing paste supply port (7) into contact with the back surface side of a squeegee (4) and vertically moving them, and further provided with a scraper (9) which scrapes up the printing paste on a screen printing plate (3).

1 Claim, 10 Drawing Sheets

PRIOR ART

PRIOR ART

SCREEN PRINTING PROCESS INCLUDING VERTICALLY MOVING SQUEEGEE TO OPEN AND CLOSE PASTE SUPPLY PORT

RELATED APPLICATION

This application is a division of U.S. patent application Ser. No. 10/067,437 filed Feb. 5, 2002, now U.S. Pat. No. 6,619,197.

BACKGROUND OF THE INVENTION

1. Field of the Invention

The present invention relates to a screen printing apparatus.

2. Description of the Conventional Art

A conventional screen printing apparatus is, for example, as shown in FIGS. 11(*a*)–11(*d*), constituted by a base plate 101 on which a substrate to be printed 102 is mounted, and a screen printing plate 103 provided in a tensional manner on the base plate 101 is substantially parallel to an upper surface of the base plate, and is structured such as to pass a printing paste 105 supplied on the screen printing plate 103 by a paste supplying means 106 in a manner shown in FIG. 11(*a*) through a pattern hole (not shown) of the screen printing plate 103 due to a movement of a squeegee 104 as shown in FIG. 11(*b*), thereby forming a pattern on the substrate to be printed 102. In this case, FIG. 11(*c*) is a view showing a state that a movement of the squeegee reaches a terminal end, and FIG. 11(*d*) is a view showing a state of moving the squeegee in an opposite direction so as to start printing.

In this case, in order to stably executed the screen printing, it is necessary to control a viscosity of the paste, a performance of the screen printing plate (a thickness of the screen printing plate, a tension balance, an accuracy, a strength, a service life and the like), a performance of the squeegee (an accuracy, a hardness, an angle and the like), a mechanical performance (an accuracy, a speed control and a pressure control) and the like so as to always keep in a uniform state.

However, in the conventional screen printing apparatus mentioned above, since the paste 105 is applied to all over the screen printing plate 103 in an exposed manner, the following problems are provided.

① Since a lot of expensive paste which costs between some tens of thousand yen and some hundreds of thousand yen is left on the screen printing plate, a lot of loss money is generated.

② Since the paste is directly supplied onto the screen printing plate, a lot of time is required for changing the paste, so that an operation efficiency is largely reduced.

③ Since the paste is exposed to an air so as to be oxidized and a property is deteriorated, an electric property and the like after printing are deteriorated.

④ Since a solvent mixed in the paste is evaporated and the viscosity is changed, a printing property is significantly deteriorated.

⑤ Since the evaporated solvent has a strong odor, a problem relating to an environment pollution is generated.

⑥ Since the viscosity of the paste is changed due to an influence of a temperature change, a printing performance is significantly deteriorated.

⑦ Since dusts are mixed within the paste, the pattern formed by the printing is disconnected and shorted. Then, in order to carry out a countermeasure thereof, a clean room which is expensive and hard to be controlled is required.

Further, in order to solve the problem mentioned above, in Japanese Unexamined Patent Publication No. 6-210829, as shown in FIG. 12, there is proposed a method of charging a printing paste 205 within a chamber 209, supplying and recovering the paste 205 through a supply port 207 which can be opened and closed, by rotating a roller 206, and printing by a front blade 208. In this case, reference numeral 202 denotes a substrate to be printed, reference numeral 203 denotes a screen printing plate and reference numeral 204 denotes a rear blade.

However, in this method, the following problems are provided.

① Since the paste is supplied due to a rotational force of the roller 206, it is necessary that the roller 206 and the paste are directly in contact with each other, so that a lot of time is required for cleaning and maintaining the roller.

② Since the paste 205 is directly supplied within the chamber 209, it is necessary to carry out a maintenance such as a periodical cleaning or the like, so that a long time is required for the maintenance operation.

③ Since the paste 205 is directly supplied within the chamber 209, a lot of time is required for changing the paste, so that an operation efficiency is largely reduced.

④ Since a lot of expensive paste which costs between some tens of thousand yen and some hundreds of thousand yen per 1 kg is left within the chamber 209, a lot of loss money is generated.

⑤ Since an air is mixed at a time of supplying the paste 205 within the chamber 209, a defect such as a wire disconnection, a chip or the like is generated in a pattern after printing.

⑥ Since an inner portion of the chamber 209 is exposed to the air, the paste is oxidized or deteriorated.

⑦ It is necessary to control an elastic force of the squeegee, a wetting property of a surface of the squeegee and the like in correspondence to a property of the paste, however, in this example, since the squeegee is executed by the front blade 208 constituted by a thin plate metal, it is possible to adjust only on the basis of the metal, so that it is impossible to adjust a suitable elastic force.

SUMMARY OF THE INVENTION

The present invention is made by taking the points mentioned above into consideration, and an object of the present invention is to provide a screen printing apparatus which can always keep a printing paste in a uniform state, can print stably at a high accuracy, and can use an expansive paste with no waste, whereby it is possible to solve all of the problems mentioned above.

A screen printing apparatus provided with a means for solving the problem mentioned above is as follows.

(1) A screen printing apparatus for pattern-forming of a printing paste on a screen printing plate onto a substrate to be printed by moving a squeegee in a predetermined direction, comprising:

a bag-like container in which the printing paste is charged;

a mechanism for receiving the bag-like container and pressurizing the bag-like container;

a printing paste supply plate provided with a printing paste supply port; and an elastic squeegee in which a back surface is formed at a fixed angle corresponding to an angle at a time of printing and a front surface is integrally formed with a hard thin plate, wherein the mechanism for pressurizing the bag-like container is connected to the back surface side of the printing paste supply plate, the back surface of the squeegee is brought into contact with the printing paste supply port in the front surface side of the printing paste supply plate, and the screen printing apparatus is provided with a printing paste supply mechanism capable of being opened and closed through a vertical movement so as to supply a predetermined amount of printing paste, and a scraper for scraping up the printing paste on the screen printing plate.

(2) A screen printing apparatus for pattern-forming of a printing paste on a screen printing plate onto a substrate to be printed by moving a squeegee in a predetermined direction, comprising:

a step of moving upward the squeegee so as to open a printing paste supply port;

a step of pressurizing a container in which the printing paste is charged so as to supply a predetermined amount of printing paste;

a step of moving downward the squeegee after supplying the predetermined amount of printing paste so as to close the printing paste supply port and simultaneously arranging the squeegee on a screen printing plate;

a step of printing with the hard thin plate side of the elastic squeegee in which a front surface is integrally formed by a hard thin plate; and a step of scraping up the printing paste on the screen printing plate by a scraper after printing, whereby the printing is carried out by repeating these steps.

(3) A screen printing apparatus in which a bag-like container charged with a printing paste is manufactured by a step of welding three peripheral portions, a step of cutting an inner side of one end among three welded portions, a step of again welding a closest outer side in the cut portion, a step of bonding the cut portion by an adhesive tape, a step of charging the paste, and a step of welding the remaining peripheral one, the bag-like container charged with the printing paste is inserted to a cartridge and set in the screen printing apparatus together with the cartridge, and the printing is carried out after the adhesive tape bonding the cut portion being peeled off.

DESCRIPTION OF THE PREFERRED EMBODIMENTS

A description will be given of an embodiment in accordance with the present invention with reference to the accompanying drawings.

Figure 1A:
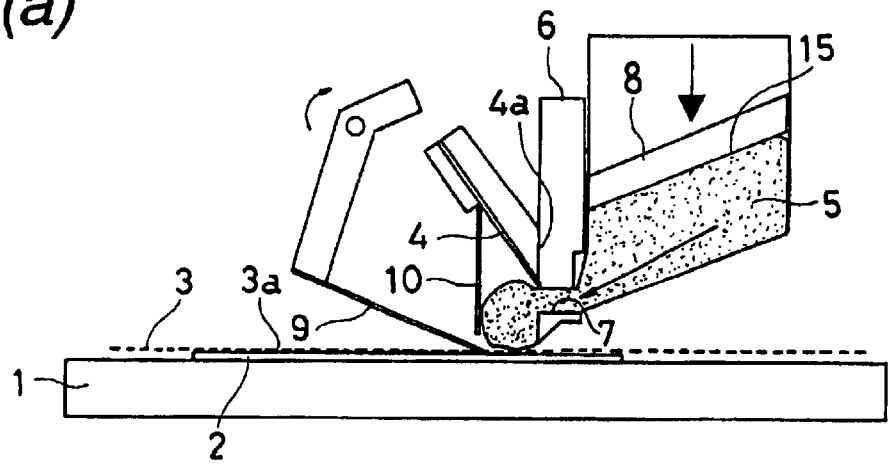
FIGS. 1(*a*)–1(*c*) are schematic views of a screen printing apparatus in accordance with the present invention.
Figure 1B:
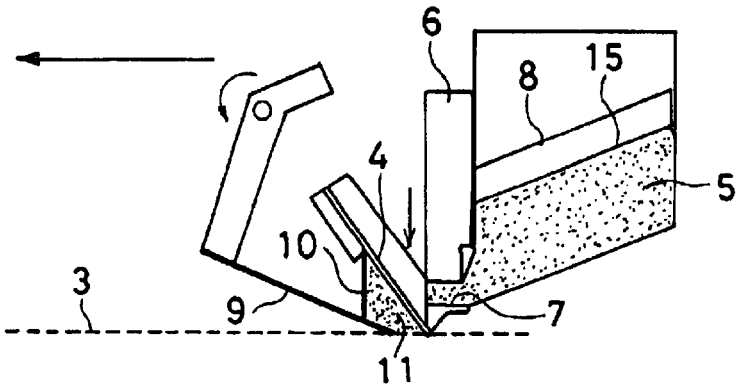
Figure 1C:
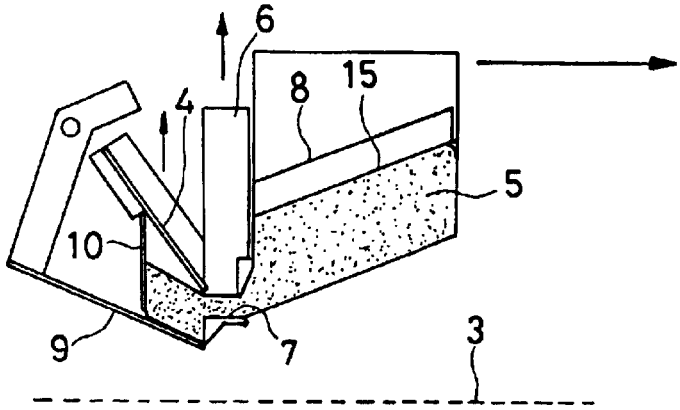
Figure 2:
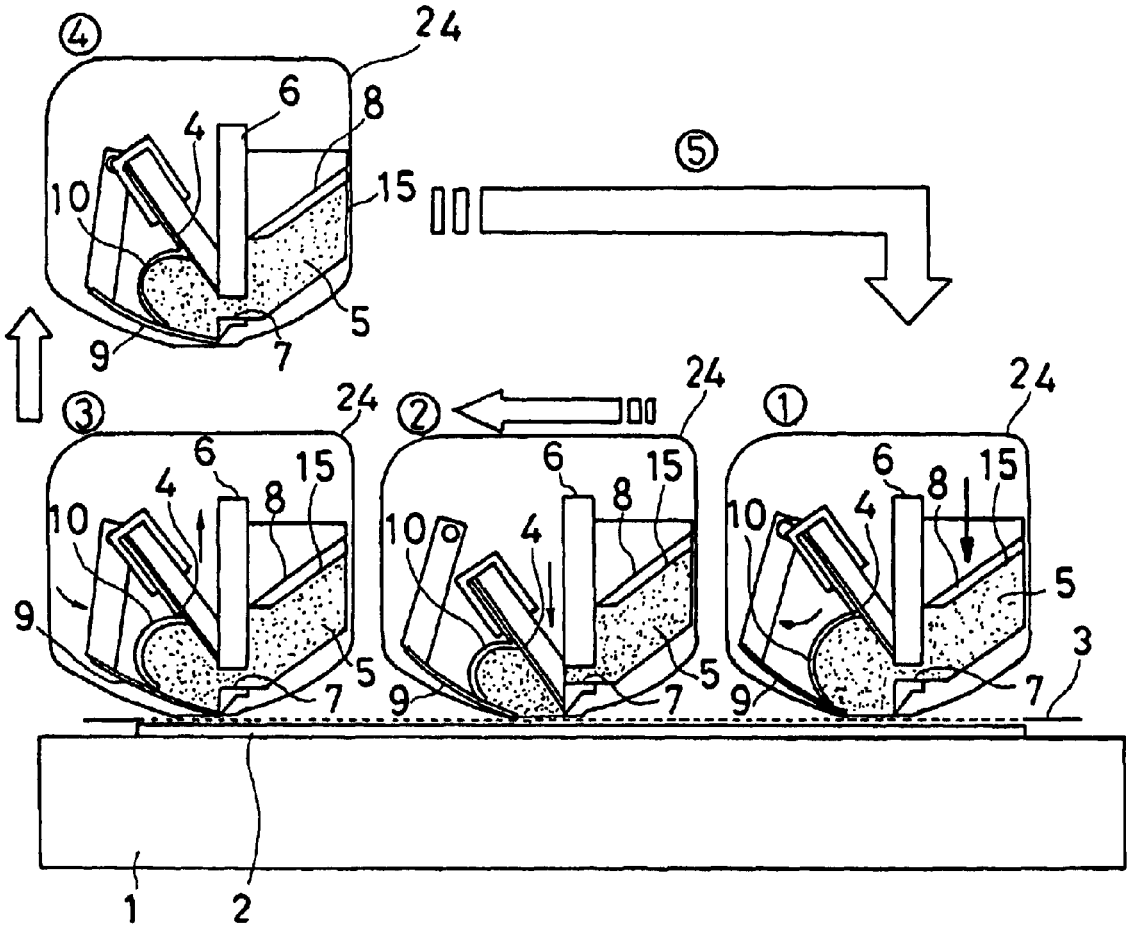
FIG. 2 is a schematic view or a printing order in accordance with the present invention.
Figure 3:
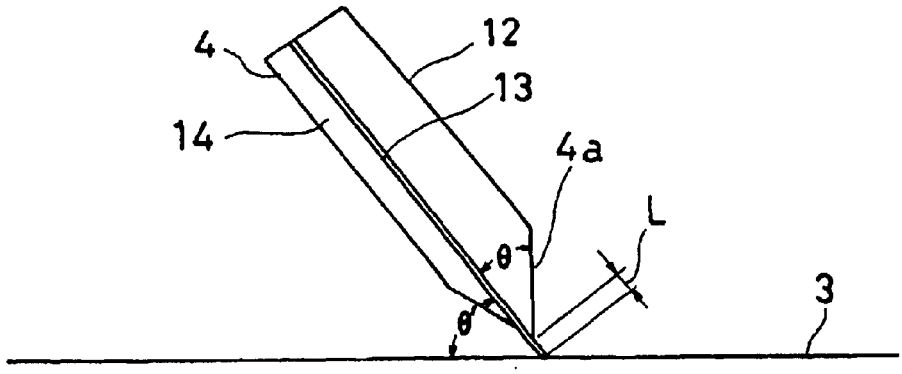
FIG. 3 is a schematic view of a squeegee in accordance with the present invention.
Figure 4A:
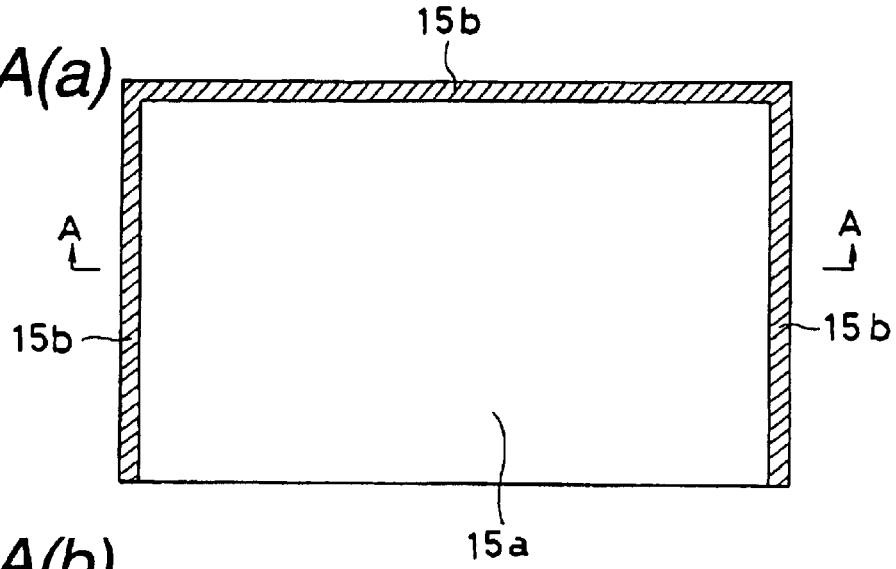
FIGS. 4A(*a* ), 4A(*b*), 4A(*c*), and 4A(*d* ) are schematic views of a manufacturing step of a printing paste supply bag in accordance with the present invention, in which (a) is a plan view, (b) is a cross sectional view along a line A—A in (a), (c) is a bottom view and (d) is a cross sectional view along a line B—B in (c)
Figure 4A:
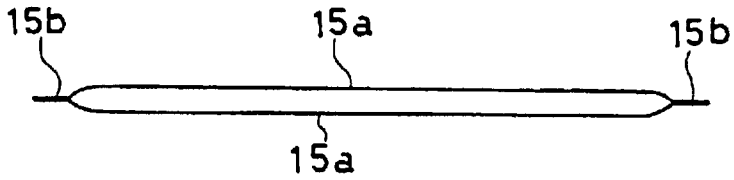
Figure 4A:
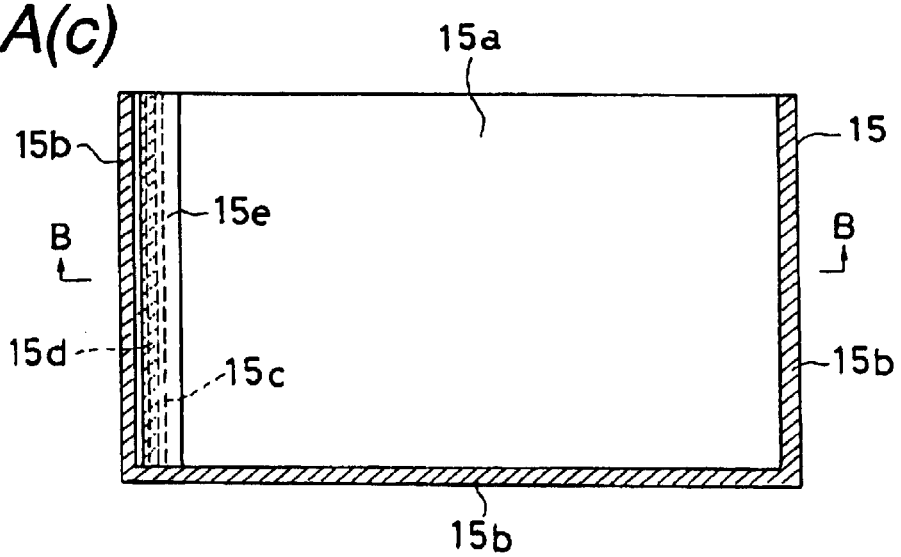
Figure 4A:
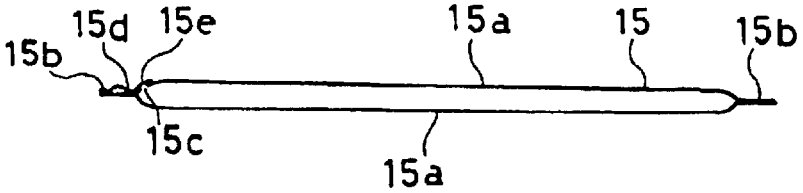
Figure 4B:
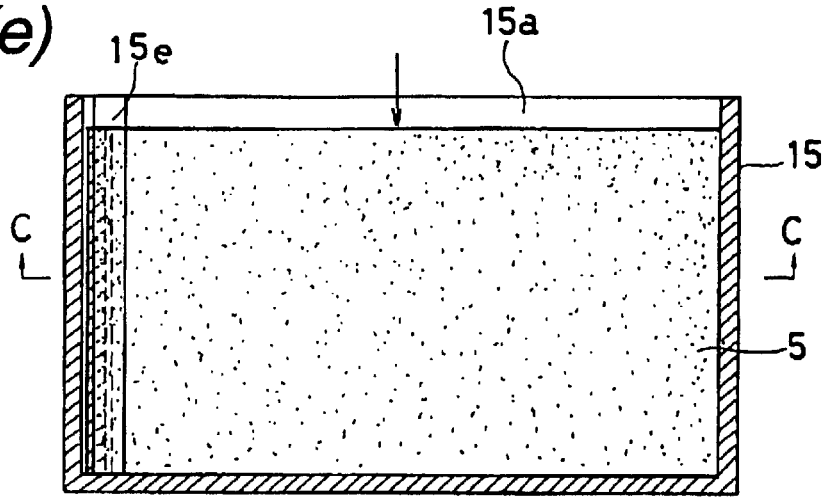
FIGS. 4B(*e*), 4B(*f*), and 4B(*g*) are schematic views of the manufacturing step of the printing paste supply bag in accordance with the present invention, in which (e) is a bottom view, (f) is a cross sectional view along a line C—C in (e) and (g) is a bottom view.
Figure 4B:
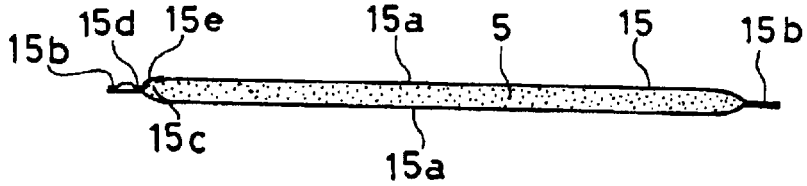
Figure 4B:
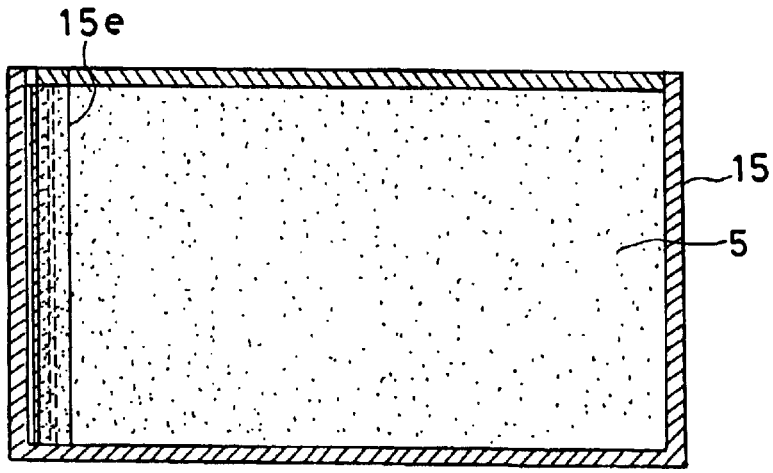
Figure 5A:
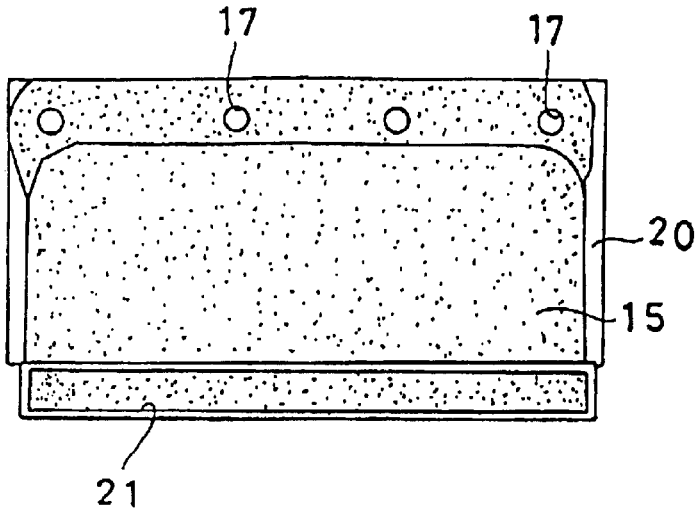
FIGS. 5(*a*)–5(*c*) are schematic views of a paste cartridge and the printing paste supply bag in accordance with the present invention.
Figure 5B:
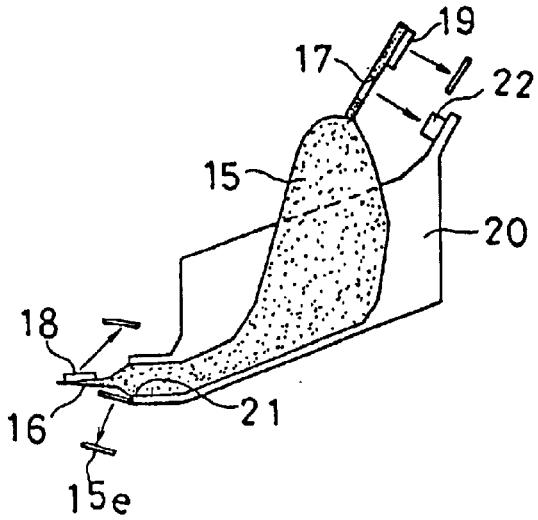
Figure 5C:
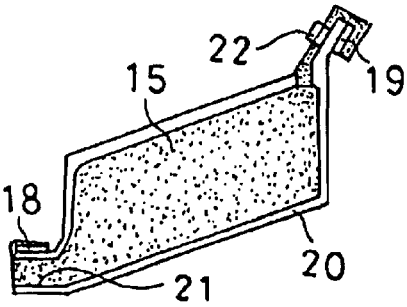
Figure 6A:
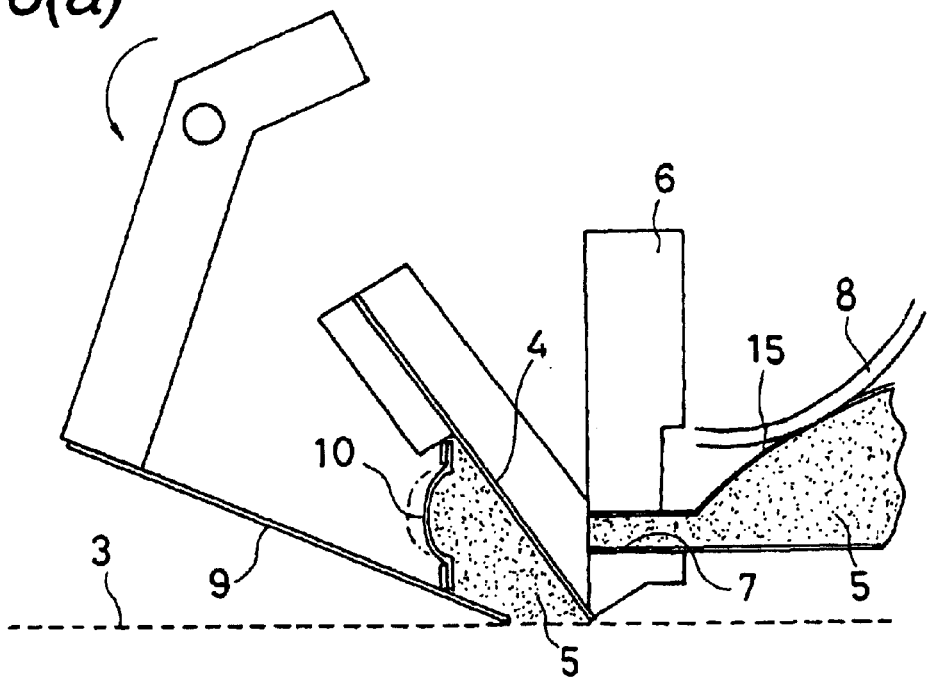
FIGS. 6(*a*) and 6(*b*) are schematic views of an elastic partition portion in accordance with the present invention.
Figure 6B:
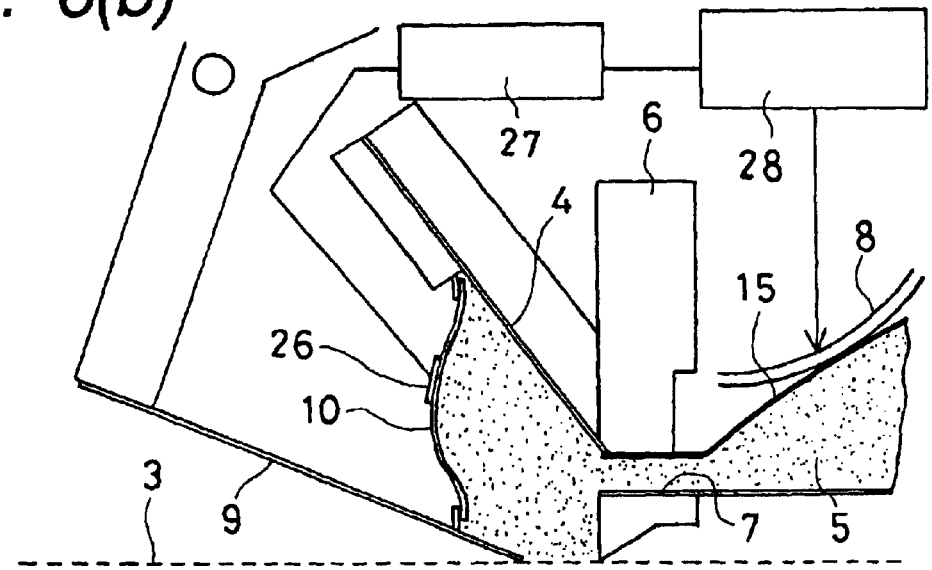
Figure 7:
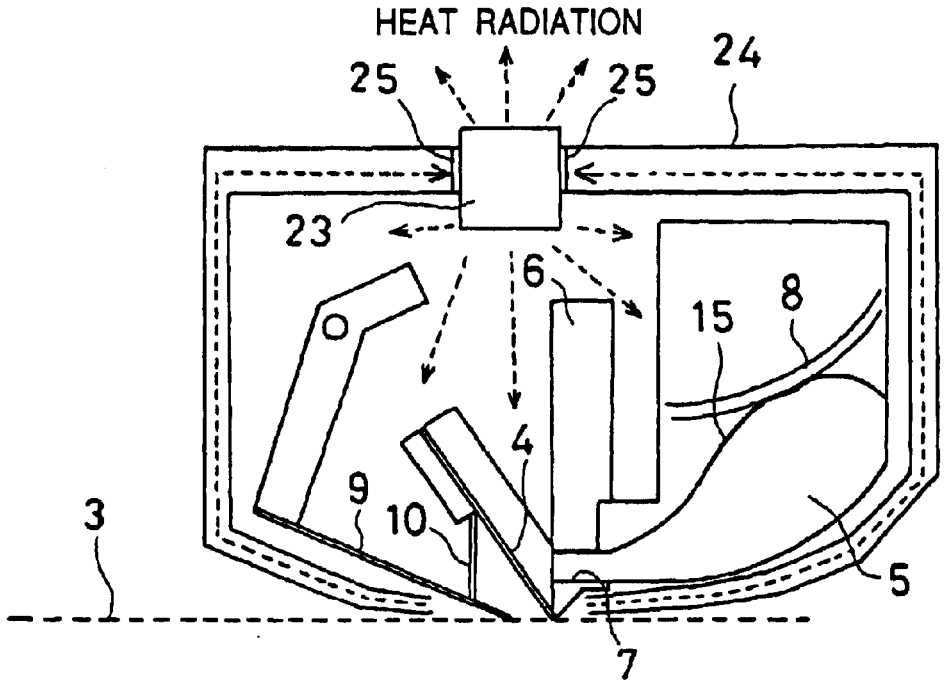
FIG. 7 is a schematic view of a temperature control apparatus in accordance with the present invention.
Figure 8:
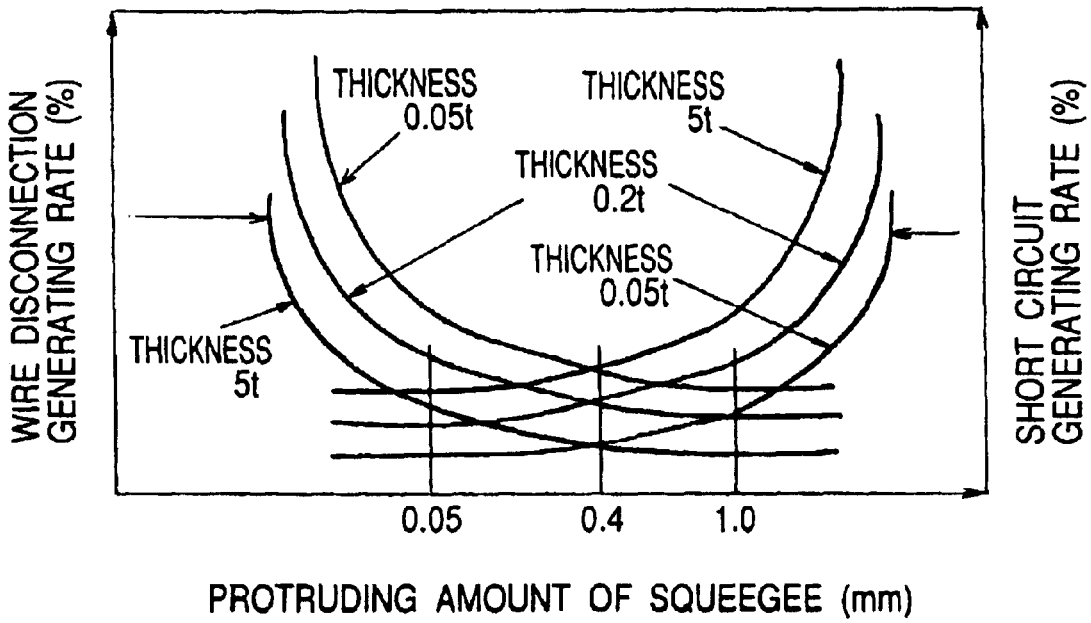
FIG. 8 is a schematic view showing a relation between a protruding amount of a squeegee and a defect generating rate in accordance with the present invention.
Figure 9:
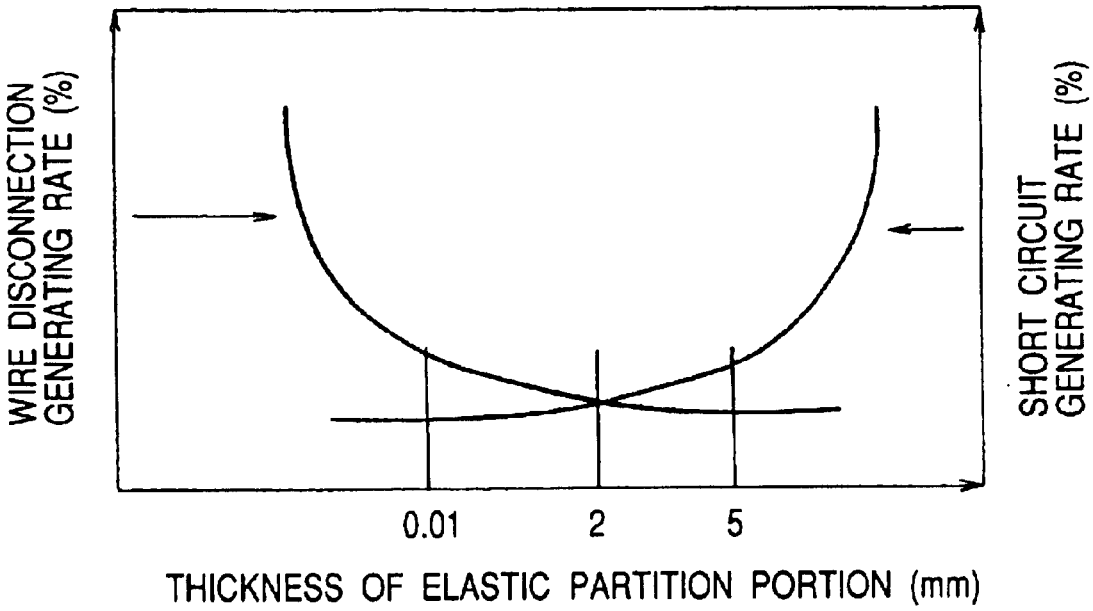
FIG. 9 is a schematic view showing a relation between a thickness of the elastic partition portion and the defect generating rate in accordance with the present invention.
Figure 10:
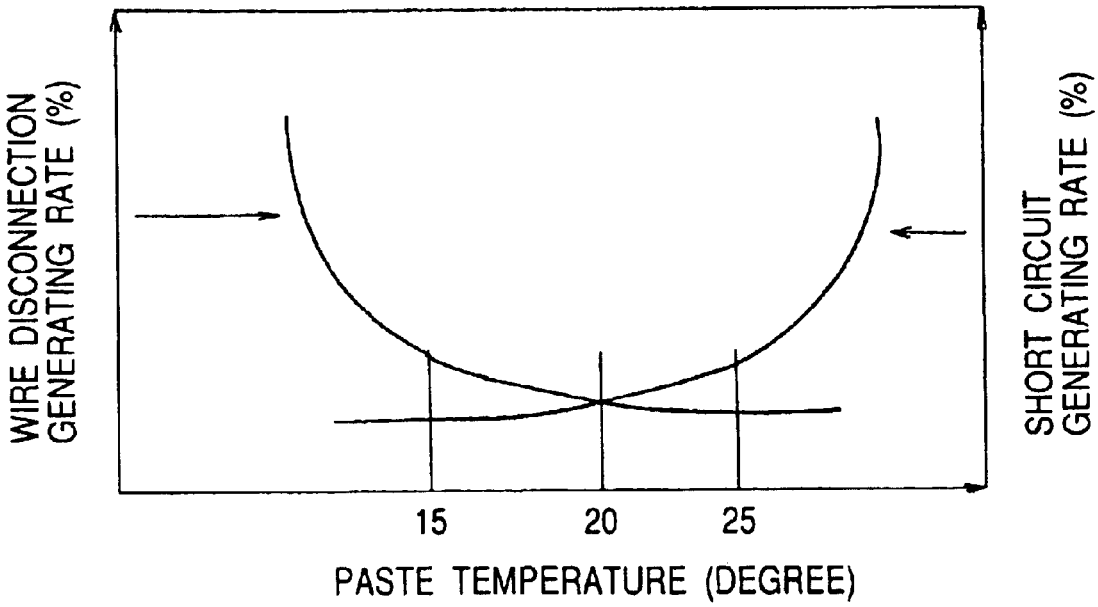
FIG. 10 is a schematic view showing a relation between a paste temperature and the defect generating rate in accordance with the present invention.
Figure 11A:
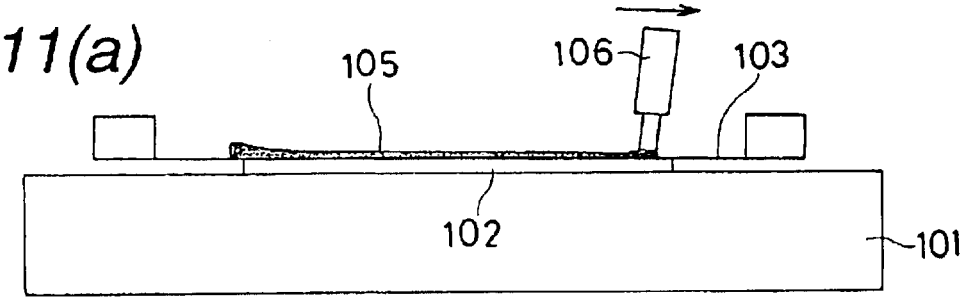
FIGS. 11(*a*)–11(*d*) are schematic views of a conventional screen printing apparatus.
Figure 11B:
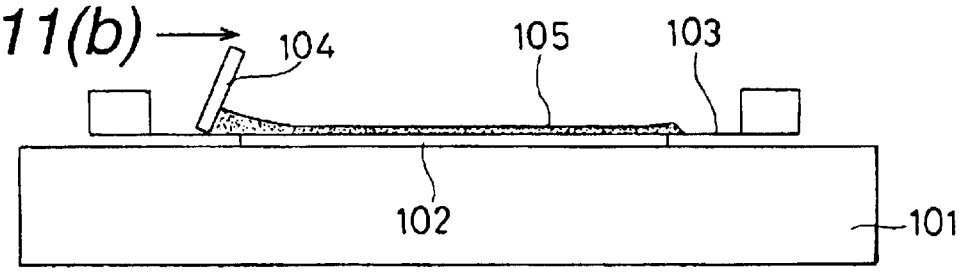
Figure 11C:
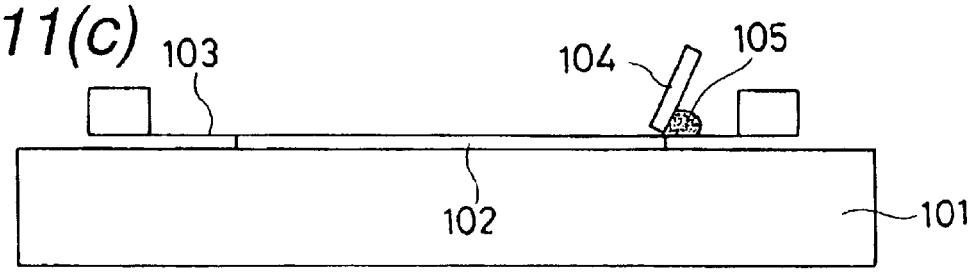
Figure 11D:
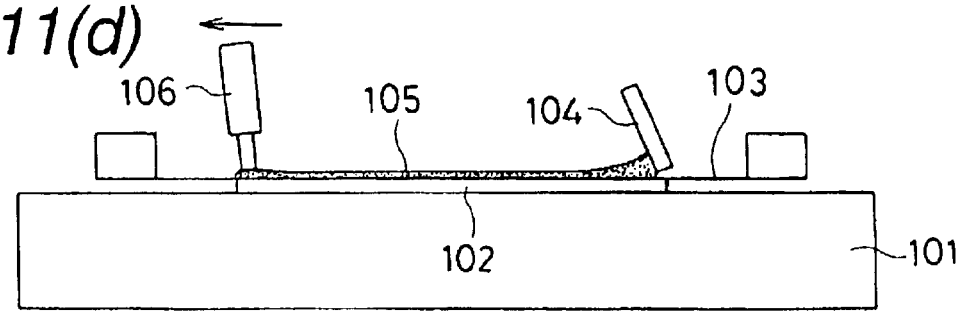
Figure 12:
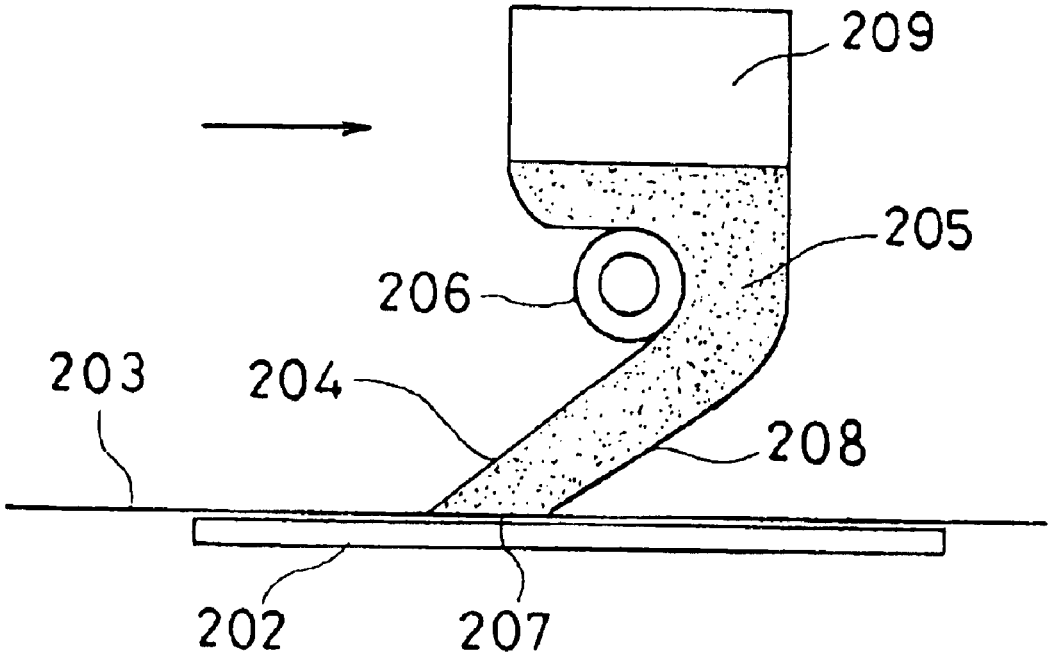
FIG. 12 is a cross sectional view of a conventional paste supplying apparatus.

FIGS. 1(*a*) to (*c*) are schematic views of a screen printing apparatus in accordance with an embodiment of the present invention, FIG. 2 is a schematic view or a printing order, FIG. 3 is a schematic view of a squeegee, FIG. 4A is a schematic view of a manufacturing step of a printing paste supply bag in accordance with the present invention, in which (a) is a plan view, (b) is a cross sectional view along a line A—A in (a), (c) is a bottom view and (d) is a cross sectional view along a line B—B in (c), FIG. 4B is a schematic view of the manufacturing step of the printing paste supply bag in accordance with the present invention, in which (e) is a bottom view, (f) is a cross sectional view along a line C—C in (e) and (g) is a bottom view, FIGS. 5(*a*) to (*d*) are schematic views of a paste cartridge, FIGS. 6(*a*) and (*b*) are schematic views of an elastic partition portion, FIG. 7 is a schematic view of a temperature control apparatus, FIG. 8 is a schematic view showing a relation between a protruding amount of a squeegee and a defect generating rate, FIG. 9 is a schematic view showing a relation between a thickness of the elastic partition portion and the defect generating rate, and FIG. 10 is a schematic view showing a relation between a paste temperature and the defect generating rate.

In the drawings, reference numeral 1 denotes a base plate, reference numeral 2 denotes a substrate to be printed, reference numeral 3 denotes a screen printing plate, reference numeral 4 denotes a squeegee, reference symbol 4*a* denotes a squeegee back surface, reference numeral 5 denotes a printing paste, reference numeral 6 denotes a printing paste supply plate in which a printing paste supply port 7 is provided, reference numeral 8 denotes a printing paste pressurizing apparatus, reference numeral 9 denotes a scraper, reference numeral 10 denotes an elastic partition portion provided between the squeegee and the scraper, and reference numeral 11 denotes a printing paste storage.

Reference numeral 12 denotes an elastic plate in a side of a back surface of the squeegee 4, reference numeral 13 denotes a thin plate made of a hard material in the squeegee 4, and reference numeral 14 denotes a reinforcing elastic plate in a side of a front surface of the squeegee 4. In this case, details of the squeegee 4 are described later. Reference numeral 15 denotes a printing paste supply bag, reference numeral 16 denotes a front end sealed portion of the printing paste supply bag, reference numeral 17 denotes a fixing hole at a rear end portion of the paste supply bag, and reference numerals 18 and 19 denote a double-sticky tape.

Reference numeral 20 denotes a cartridge for containing the paste supply bag 15, reference numeral 21 denotes a paste supply port in the cartridge 20, and reference numeral 22 denotes a fixed projection at the rear end portion of the printing paste supply bag. Reference numeral 23 denotes a temperature control apparatus, reference numeral 24 denotes a duct commonly serving as a sealed cover, and reference numeral 25 denotes a filter.

Next, a description will be given of an operation of the present embodiment with reference to FIGS. 1 and 2.

The screen printing apparatus in accordance with the present embodiment is constituted by the base plate 1 in which the substrate to be printed 2 is mounted as mentioned above, the screen printing plate 3 provided in a tensional manner on the base plate 1 with a predetermined interval (for example, between 0.5 and 5.0 mm), the squeegee 4 arranged on the screen printing plate 3, the printing paste 5 sealed in the printing paste supply bag 15, the printing paste supply plate 6 provided with the printing paste supply port 7, the printing paste pressurizing apparatus 8, the scraper 9 and the elastic partition portion 10.

Then, at first, as shown in FIG. 1(*a*), a new substrate to be printed 2 is mounted on the base plate 1, the screen printing plate 3 is positioned on the substrate to be printed 2 and they are arranged to be overlapped. At this time, the printing paste 5 is stored in a state of being sealed in the printing paste supply bag 15. Further, it is possible to prevent the paste from being deteriorated by closing the printing paste supply port 7 of the printing paste supply plate 6 by means of a back surface of the squeegee 4 at a time when the printing is not carried out.

At a time of printing, the printing paste supply port 7 is opened by positioning the squeegee 4 above the printing paste supply port 7 by sliding a wall surface in the front surface side of the printing paste supply plate 6. Next, a predetermined amount of printing paste 5 is extruded outward from the printing paste supply port 7 by being pressurized by the printing paste pressurizing apparatus 8. Further, as shown in FIG. 1(*b*), the printing paste supply port 7 is closed by sliding the squeegee 4 downward along the wall surface of the printing paste supply plate 6, the printing paste storage 11 is formed by a space surrounded by the scraper 9, the elastic partition portion 10, the squeegee 4 and the screen printing plate 3, and the printing paste 5 is sealed therein. Then, a pattern is printed on the substrate to be printed 2 by moving them in this state on the screen printing plate 3.

At this time, the squeegee 4, the printing paste 5, the printing paste supply plate 6, the printing paste pressurizing apparatus 8, the scraper 9, and the elastic partition portion 10 integrally move. Further, such movement, and the vertical motions of the squeegee 4, the printing paste pressurizing apparatus 8 and the scraper 9 and the like can be driven by a known actuator such as a hydraulic or air cylinder, a motor, a solenoid and the like.

When the printing operation is completed, the remaining paste 5 on the screen printing plate 3 is scraped up by rotating the scraper 9 in a direction of the squeegee 4 while sliding the scraper 9 on the screen printing plate 3, as shown in FIG. 1(*c*) and the squeegee 4, the printing paste 5, the printing paste supply plate 6, the printing paste pressurizing apparatus 8, the scraper 9 and the elastic partition portion 10 which are integrally formed as mentioned above are moved upward so as to be returned to a position at a time of starting the printing. A new substrate to be printed 2 is mounted on the base plate 1 and the next printing is carried out by repeating these series of operations. Further, FIG. 2 shows an explanation of these series of operations, in which ① shows a paste injection, ② shows a printing, ③ shows a paste scraping, ④ shows a paste transfer, and ⑤ shows a return to the start point, respectively.

The present embodiment can obtain the following effects on the basis of the structures and the operations mentioned above.

① Since the printing paste 5 is supplied by being pressurized by the pressurizing apparatus 8 in the state that the printing paste 5 is seared in the printing paste supply bag 15, it is possible to make a remaining amount within the printing paste supply bag 15 minimum. Since it is possible to scrape up almost all of the remaining paste after printing by the scraper 9, it is possible to use the expensive paste which costs some tens of thousand yen to some hundreds of thousand yen per 1 kg with no waste.

② Since the paste 5 is sealed in the printing paste supply bag 15, it is easy to change the paste 5, and it is possible to largely improve an operation efficiency.

③ Since the paste is not exposed to the air for a long time, the paste is not oxidized and an electric property after printing is not deteriorated.

④ Since the solvent mixed in the paste is not evaporated and the viscosity is not changed, a printing property becomes stable.

⑤ Since the solvent is hardly evaporated, it is possible to restrict the generation of odor to a low level and the problem of the environment pollution is not generated.

⑥ Since the paste is hardly affected by the temperature change, the paste viscosity is not deteriorated.

⑦ Since the dusts are hardly mixed into the paste, the pattern formed by printing is not disconnected or shorted. Further, the clean room which is expensive and hardly controlled is not required.

Next, a description will be given of details of the squeegee 4 with reference to FIGS. 3 and 8. FIG. 3 shows a structure of the squeegee 4, and FIG. 8 shows a relation between a protruding amount of the squeegee and a defect generating rate. The squeegee 4 is constructed by layering the back surface side elastic plate 12 and the thin plate 13 made of the hard material. The elastic plate 12 is made of an urethane rubber, suitably with a hardness between 60 and 100 degrees and a thickness between 3 and 10 mm, and the thin plate 13 is made of the hard material suitably such a metal as a SUS, a phosphor bronze or the like. Further, since the squeegee 4 also opens and closes the paste supply port 7 of the printing paste supply plate 6 by the back surface thereof, an edge of a contact portion at a front end portion with the screen printing plate 3 is acuminated sharply. Further, it is in a shape as easily abraded accordingly. Further, an angle formed by the screen printing plate 3 and the squeegee 4 is an important factor affecting the printing performance, and the printing is normally executed at the angle between 45 and 60 degrees. An angle $\theta$ of the front end of the squeegee 4 is obtained by a formula 90 degrees $-\theta'$, that is, in the case that $\theta'$ is 45 degree, the angle becomes 45 degrees, and in the case that $\theta'$ is 60 degrees, the angle becomes 30 degrees. In the case that the rubber strength becomes weak when the front end angle $\theta$ becomes 30 degrees, the reinforcing elastic plate 14 may be provided in the front surface side.

Further, the thin plate 13 of the hard material is made of SUS, with a thickness between 0.05 and 0.5 mm, most suitably 0.2 mm. Further, a protruding amount L of the thin plate 13 made of the hard material is set to be between 0.05 and 1.0 mm, most suitably about 0.4 mm. In this case, a relation between the protruding amount of the squeegee 4 and the defect generating rate is as shown in FIG. 8. Since an accuracy of the front end is high, the abrasion is a little and the suitable spring force is obtained by using the thin plate 13 made of the hard material, it is possible to carry out an accurate printing.

Next, a description will be given of a method of manufacturing the printing paste supply bag 15 shown in FIGS. 4A and 4B.

At first, as shown in FIGS. 4A(*a*) and 4A(*b*), two sheets 15*a* are layered with each other and a welded portions 15*b* are formed at three peripheral portions in accordance with a thermal welding. The sheet 15*a* is made, for example, in a three-layer structure comprising a polyethylene, a linear loden (LL) and a nylon, and the LL and the polyethylene are welded with each other. Further, the sheet 15*a* may be constituted by an elastic body such as a rubber or the like. In this case, the paste is charged by applying the pressure on the basis of the manner of a rubber balloon so as to be enlarged. Accordingly, the paste becomes easily output due to a contractile force, and no twist or no wrinkle is generated due to a restoring force of the rubber.

Next, as shown in FIGS. 4A(*c*) and 4A(*d*), the sheet end cut portion 15*c* is provided by cutting an inner side of one end among three welded portions, and a re-welded portion 15*d* is provided by re-welding an outer position close to the sheet end cut portion 15*c*. The re-welded portion 15*d* is provided for the reason of restricting the waste of the paste to be minimum. Next, the sheet end cut portion 15*c* is bonded by an adhesive tape 15*e*. Further, as shown in FIGS. 4B(*e*) and 4B(*f*), the paste 5 is charged within the completed bag and finally the remaining one peripheral portion is welded as shown in FIG. 4B(*g*), whereby the manufacturing of the printing paste supply bag 15 is finished.

Then, the printing paste supply bag 15 in which the printing paste 5 is charged as mentioned above is inserted to the cartridge 20 and is set to the screen printing apparatus together with the cartridge 20 in a state of peeling off the adhesive tape 15 bonding the sheet end cut portion 15*c* being peeled off, whereby the printing is carried out. Further, a method of inserting the printing paste supply bag 15 to the cartridge 20 is as shown in FIG. 5. The cartridge 20 corrects a shape of the printing paste supply bag 15, and a material thereof is constituted of a material having a rigidity higher than that of the printing paste supply bag 15, such as a plastic, a metal or the like. In this case, FIG. 5(*a*) is a front view of a state that the paste supply bag is inserted to the cartridge, and FIG. 5(*b*)is a side view of the same.

As shown in FIG. 5(*b*), the printing paste supply bag 15 is structured such that the printing paste 5 is charged therein, thereafter the sealed portion 16 is formed at the front end, and the double-sticky tape 18 is adhered to the sealed portion 16. Next, the front end sealed portion 16 of the printing paste supply bag 15 and the double-sticky tape 18 are inserted to the paste supply port 21 in the cartridge 20, thereafter the fixed projection 22 provided in the cartridge 20 is inserted to the fixing hole 17 provided in the printing paste supply bag 15, and the rear end of the printing paste supply bag 15 is fixed to the rear end portion of the cartridge 20 by the double-sticky tape 19. Next, as shown in FIG. 5(*c*), the front end of the printing paste supply bag 15 is fixed to the front end of the cartridge 20 by the double-sticky tape 18 on the front end sealed portion 16. Next, the adhesive tape 15*e* bonding the sheet end cut portion 15*c* is peeled off. Accordingly, the printing paste supply bag 15 is opened and the printing paste 5 can be supplied. Further, it is possible to further improve the effect of the present invention by providing with the elastic partition portion 10 as shown in FIG. 6 so as to optimize. FIGS. 6(*a*) and 6(*b*) are structural views of the elastic partition portion, and FIG. 9 is a schematic view showing a relation between a thickness of the elastic partition portion and the defect generating rate. In this case, FIG. 6(*a*) shows a normal example, and FIG. 6(*b*) shows an example of a case of precisely controlling a supply amount of the printing paste. The elastic partition portion 10 is structured such as to adjust the supply amount of the printing paste 5 and optimize a pressurizing force applied to the screen printing plate 3 by the paste. A material of the elastic partition portion 10 is preferably a rubber, a plastic, a spring-like thin plate metal or the like. Further, as shown in FIG. 9, in the case of the rubber, it is preferable that the thickness is set to be between 0.01 and 5 mm, most suitably about 1 mm.

The printing paste 5 supplied by the printing paste pressurizing apparatus 8 is supplied in to the printing paste storage 11 formed by the space surrounded by the scraper 9, the elastic partition portion 10, the squeegee 4 and the screen printing plate 3, and is charged up to the elastic partition portion 10. In the case of charging over the elastic partition portion 10, the elastic partition portion 10 deforms so as to correspond this. At this time, the deformation of the rubber, the plastic, the metal or the like applies the pressurizing force to the paste 5, and the pressurizing force is transmitted to the screen printing plate 3, and presses the paste 5 to the pattern (not shown) of the screen printing plate 3 together with the movement of the squeegee 4, whereby it is possible to carry out an accurate printing.

Next, a description will be given of a method of precisely controlling the supply amount of the printing paste 5 shown in FIG. 6(*b*). A load sensor 26 provided in the elastic partition portion 10, a load sensor amplifier 27 and a paste supply amount control circuit and pressurization controller 28 are provided, and a load applied to the elastic partition portion 10 is detected by the load sensor 26, whereby the paste supply amount is controlled to an optimum amount.

Next, a description will be given of a temperature control apparatus with reference to FIGS. 7 and 10. FIG. 7 is a schematic view showing a structure of the temperature control apparatus, and FIG. 10 is a schematic view showing a relation between a paste temperature and the defect generating rate. As shown in FIG. 10, a viscosity of the paste is largely changed in correspondence to the temperature and a printing property of the paste is largely changed due to a change of the viscosity. However, the temperature control is very hard, and is normally done by controlling an air condition within a large room such as a clean room or the like which is expensive and whose temperature is hard to be precisely controlled. In accordance with the present invention, a highly precise printing is carried out by receiving the squeegee 4, the paste 5 and the like within a compact sealed container and controlling the temperature within the sealed container.

As shown in FIG. 7, the squeegee 4, the printing paste 5, the printing paste supply plate 6, the printing paste pressurizing apparatus 8, the scraper 9 and the elastic partition portion 10 are sealed by the duct 24 commonly serving as the sealed cover, so as to form a compact container. A temperature control apparatus 23 is provided in a ceiling portion of the duct 24 serving as the sealed cover. As the temperature control apparatus 23, a cooling apparatus using an electronic cooling device due to a Pertie effect is suitable because of being compact, capable of being controlled only by turning on and off an electric current, and being quick in response. By employing the compact sealed container, it is possible to carry out the temperature control at a high accuracy and securely.

A stream of the cooling air flows out from the temperature control apparatus 23 so as to fill the duct 24 commonly serving as the sealed cover with the cooling air, and returns to the temperature control apparatus 23 through a duct portion of the duct 24 commonly serving as the sealed cover. In this case, the stream passes through a dust removing filter 25 in the middle thereof. Accordingly, since the cooling air does not leak out to the external, the following effect can be obtained.

① A cooling effect is increased.

② Cleanness degree of the air can be maintained.

Further, it is possible to prevent the paste from being deteriorated by charging a nitrogen gas in place of the air.

As the screen printing plate 3, for example, there is employed a structure obtained by adhering a photosensitive emulsion or a metal mask having a thickness between about 5 and 50 $\mu$m to a stainless mesh having a mesh size between about 300 and 500, and for example, in the case of employing the screen printing plate 3 using the photosensitive emulsion, a predetermined pattern hole 3*a* is formed by patterning the photosensitive emulsion via exposing and developing steps. In this case, the screen printing plate 3 is provided in a tensional manner, for example, at a position 0.5 to 5.0 mm apart from the upper surface of the base plate 1 in an initial stage before starting the printing.

Further, the squeegee 4 arranged on the screen printing plate 3 is structured such as to charge the printing paste 5 in the pattern hole 3*a* of the screen printing plate 3 by moving on the screen printing plate 3 in a predetermined direction while pressing a part of the screen printing plate 3 to the substrate to be printed 2 by pressing down the screen printing plate 3, and the charged printing paste 5 is transferred and applied to the substrate to be printed 2 at a time when the squeegee 4 passes through the pattern hole 3*a* and the lower surface of the screen printing plate 3 is separated from the surface of the substrate to be printed 2. The squeegee 4 is set to press the screen printing plate 3 by a pressing force, for example, between 0.5 and 5.0 kgf/cm$^2$, and moves on the screen printing plate 3 at a speed between 0.1 and 300 mm/sec in such a manner as to slide along the upper surface of the screen printing plate 3 in this state. Further, an amount of deflection X of the screen printing plate 3 pressed by the squeegee 4 is kept at a substantially fixed value (±0.5 mm) as mentioned above during this period. In this case, the squeegee 4 mentioned above is manufactured, for example, by working the urethane rubber, the silicone rubber or the like in a plate shape or a sword shape.

Further, as the printing paste 5 used for the screen printing apparatus, it is preferable to employ a paste in which a viscosity is adjusted between 5 and 1000 Pa·s, and it is possible to make the application pattern of the printing paste 5 formed on the substrate to be printed 2 shape by setting a viscosity within this range. In accordance with the screen printing apparatus of the present invention, since the printing paste is supplied by being pressurized by means of the pressurizing apparatus in the state that the printing paste is sealed in the printing paste supply bag, it is possible to minimize the remaining amount within the printing paste supply bag. Further, since it is possible to scrape up substantially all of the remaining paste by the scraper after printing, it is possible to use the expensive paste which costs some tens of thousand yen to some hundreds of thousand yen with no waste. Further, since the paste is sealed in the printing paste supply bag, it is easy to change the paste, and it is possible to largely improve the operation efficiency.

Further, since the printing paste supply port of the printing paste supply plate is closed by the back surface of the squeegee at a time when the printing is not executed, the printing paste sealed in the printing paste supply bag is not exposed to the air for a long time. Accordingly, the paste is not oxidized, and the electric property or the like after printing is not deteriorated. Further, since the solvent mixed in the paste is not evaporated and the viscosity is not changed, the printing property becomes stable. Further, since the solvent is hardly evaporated, it is possible to restrict the generation of odor to be low, and the problem of the environment pollution is not generated. Further, since the paste is hardly affected by the temperature change, the paste viscosity is not deteriorated. Further, since the dusts are hardly mixed into the paste, the pattern formed by the printing is not disconnected or shorted. Further, the clean room which is expansive and hardly controlled is not required.

Further, since the squeegee is constructed by layering the elastic plate and the thin plate made of the hard material, an accuracy of the front end is high and an abrasion is reduced, and it is further possible to carry out an accurate printing with a suitable spring force. Further, in the case that the load sensor in the elastic partition portion the load sensor amplifier, the paste supply amount control circuit and the pressurization controller are provided, it is possible to precisely control the supply amount of the printing paste, and it is possible to apply an accurate printing paste. Further, in the case of sealing the squeegee, the printing paste, the printing paste supply plate, the printing paste pressurizing apparatus, the scraper and the elastic partition portion by the duct commonly serving as the sealed cover so as to form the compact container, and the temperature control apparatus using the electronic cooling device due to the Pertie effect is provided in the ceiling portion of the duct commonly serving as the sealed cover, it is possible to achieve the compact sealed container, it is possible to carry out the temperature control at a high accuracy and in a secure manner, and it is possible to carry out the high speed temperature control only by turning on and off the electric current. Further, the viscosity of the paste is largely changed due to the temperature, and the printing property of the paste is largely changed due to the change of the viscosity, however, in accordance with the present invention, the room such as the clean room or the like which is expensive and whose temperature is difficult to be controlled precisely is not required, and it is possible to carry out the printing at a high accuracy.

What is claimed is:

1. A screen printing process for pattern forming of a printing paste through a screen printing plate onto a substrate to be printed by moving a squeegee in a predetermined direction, comprising:

a step of providing a squeegee having a front surface integrally formed by a hard thin plate;

a step of moving upward the squeegee so as to open a printing paste supply port;

a step of pressurizing a container in which the printing paste is charged so as to supply a predetermined amount of printing paste to the screen printing plate through the printing paste supply port;

a step of moving downward the squeegee after supplying the predetermined amount of printing paste so as to close the printing paste supply port and simultaneously arranging said squeegee on a screen printing plate;

a step of printing with the hard thin plate side of the squeegee by moving the squeegee in a predetermined direction along the screen printing plate which a front surface is integrally formed by a hard thin plate; and a step of scraping up any printing paste remaining on the screen printing plate after said printing step, by using a scraper after printing, whereby the pattern forming is carried out by repeating these steps.

* * * * *